United States Patent [19]

Schumacher et al.

[11] 4,062,201

[45] Dec. 13, 1977

[54] AUTOMATIC ICEMAKER INCLUDING MEANS FOR MINIMIZING THE SUPERCOOLING EFFECT

[75] Inventors: Frank A. Schumacher; Marvel A. Elliott, both of Louisville, Ky.

[73] Assignee: General Electric Company, Louisville, Ky.

[21] Appl. No.: 732,771

[22] Filed: Oct. 15, 1976

[51] Int. Cl.[2] ..... F25C 1/00; F25C 1/10

[52] U.S. Cl. ..... 62/353; 62/66

[58] Field of Search ..... 62/353, 66, 71, 340

[56] References Cited

U.S. PATENT DOCUMENTS

| | | | |
|---|---|---|---|
| 3,040,545 | 6/1962 | Bollefer | 62/340 |
| 3,254,505 | 6/1966 | De Turk | 62/353 |
| 3,280,588 | 10/1966 | Brindley | 62/340 |
| 3,678,701 | 7/1972 | Powell et al. | 62/353 |
| 3,760,598 | 9/1973 | Jokob et al. | 62/74 |

OTHER PUBLICATIONS

Scientific American, Jan. 1961, pp. 120–131.
Scientific American, Feb. 1959, pp. 114–122.

*Primary Examiner*—William E. Wayner

*Attorney, Agent, or Firm*—Steven C. Schnedler; Francis H. Boos

[57] ABSTRACT

A batch type automatic icemaker adapted for installation in the freezing compartment of a refrigerator is provided with a water-carrying member having first and second ends. The first end of the water-carrying member is in fluid communication with at least one of the ice-forming cavities and positioned to be wetted by water therein. The second end projects into cold air within the freezer. A small quantity of water is thereby carried out of the ice-forming cavity to the second end of the member and exposed to cold air within the freezing compartment. Because the small quantity of water is of small mass and is thermally isolated from the mold, it is rapidly lowered to a temperature sufficiently low to reliably form a seed ice crystal. The seed ice crystal initiates freezing of the bulk of the water in the ice-forming cavities with a minimum of supercooling. In one embodiment of the invention, the water-carrying member is a capillary device which projects above the mold and draws water up out of the ice-forming cavity. In another embodiment, the water-carrying member is simply a tube which carries a small quantity of water from the ice-forming cavity by gravity.

10 Claims, 11 Drawing Figures

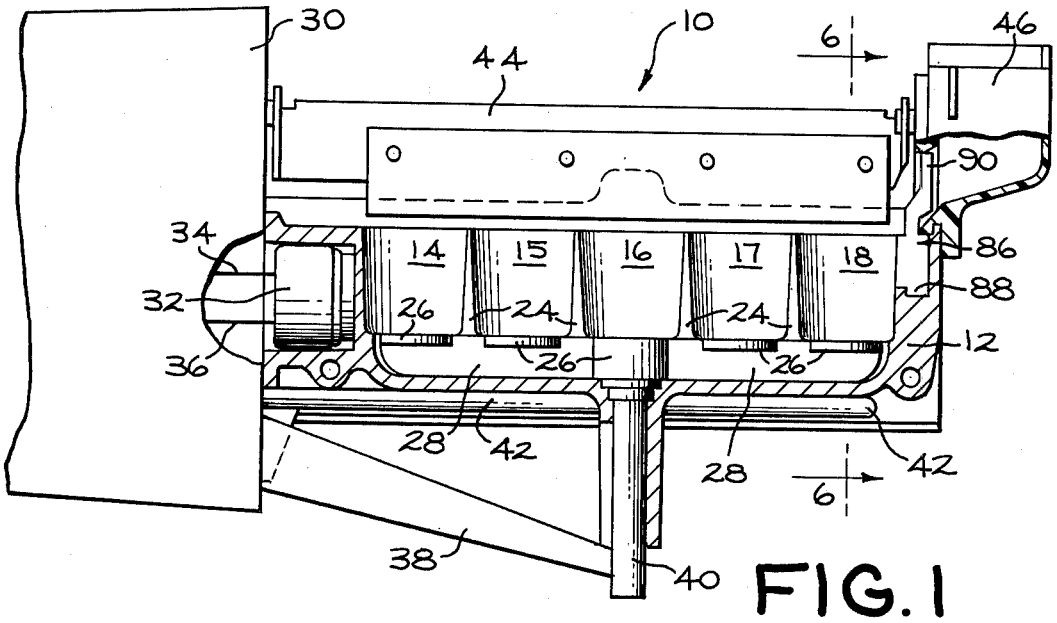
FIG. 1
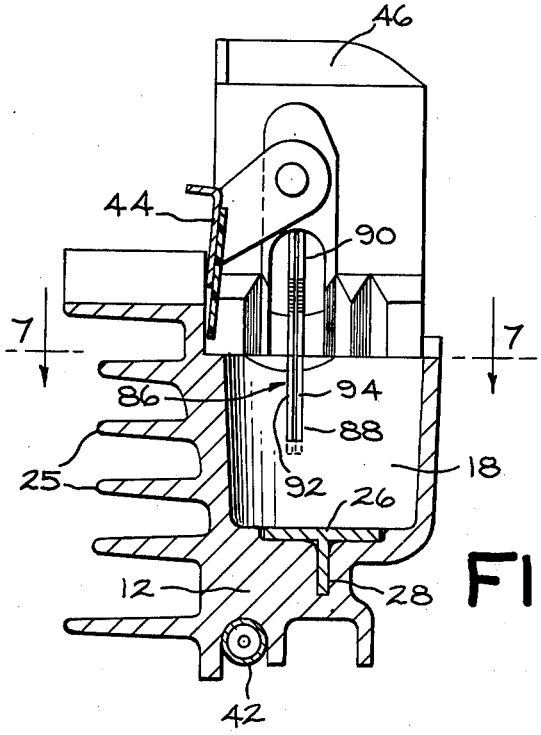
FIG. 6
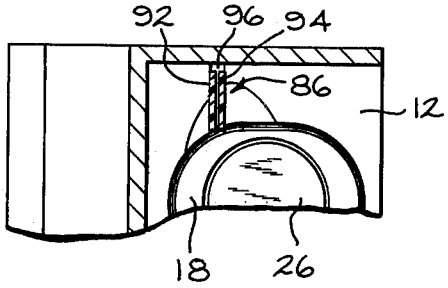
FIG. 7
FIG. 8
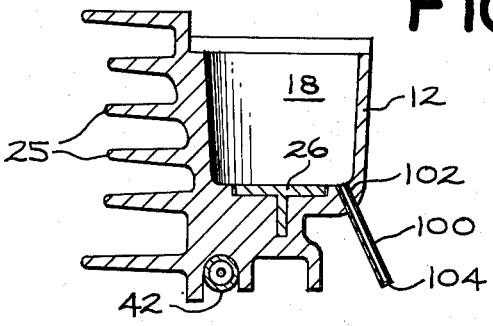
FIG. 9
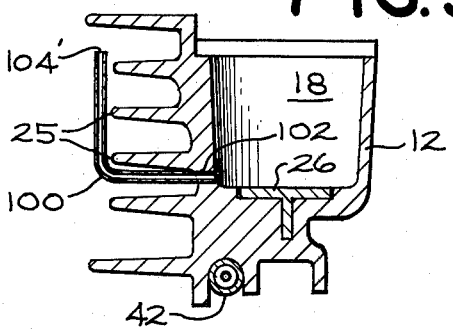

PRIOR ART
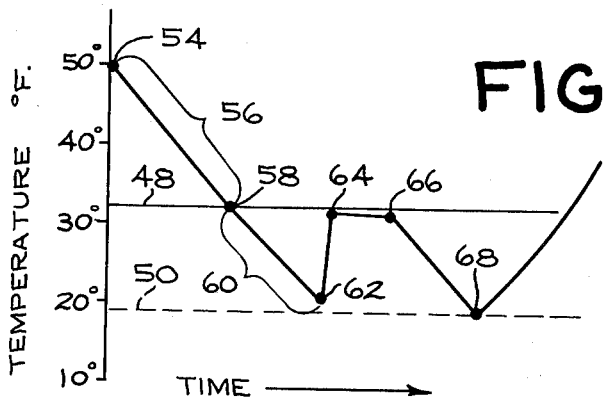
FIG.2
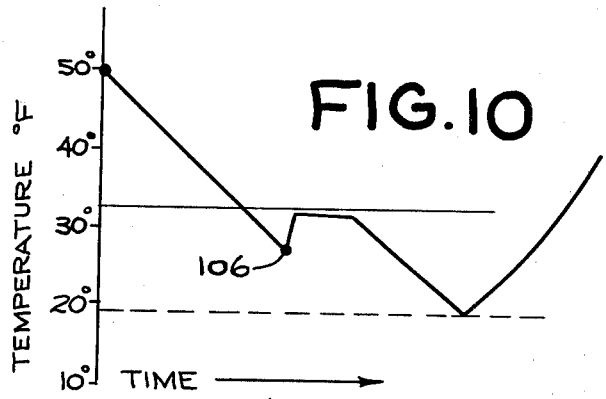
FIG.10
FIG.3
PRIOR ART
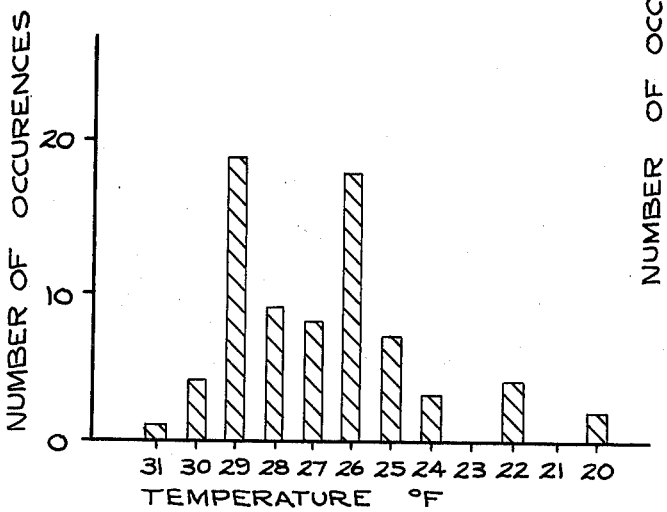
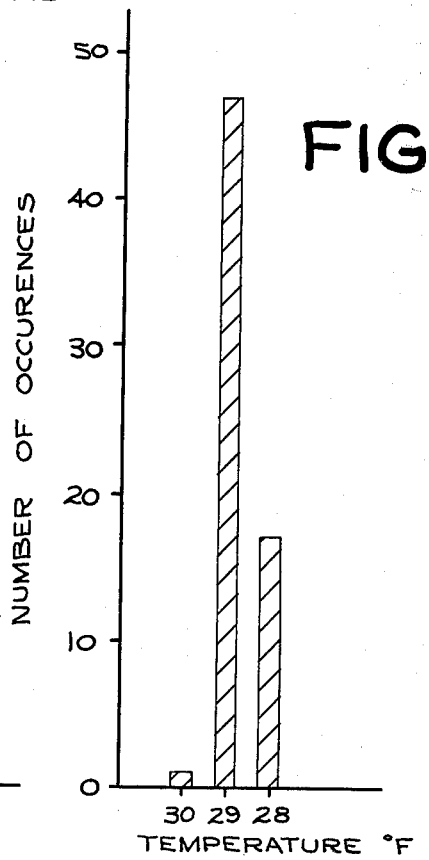
FIG.11

AUTOMATIC ICEMAKER INCLUDING MEANS FOR MINIMIZING THE SUPERCOOLING EFFECT

BACKGROUND OF THE INVENTION

1. Field of the Invention

The present invention relates generally to batch type automatic icemakers adapted for installation in the freezer compartment of household refrigerators and, more particularly, to such an icemaker including a means to minimize supercooling of water in the mold ice-forming cavities.

2. Description of the Prior Art

A refrigerator automatic icemaker of the type shown and described in U.S. Pat. Nos. 3,163,017-Baker et al and 3,163,018-Shaw includes a mold having at least one ice-forming cavity. To begin the operation cycle, a means is included for filling the ice-forming cavity with a metered quantity of tap water. As the mold and water cools, an ice piece is formed. In order to initiate harvesting of the ice piece, a control means is included. The control means typically includes a temperature-responsive switch element (thermostat) in thermal contact with the mold. The thermostat is set to respond to a temperature well below 32° F. It is assumed that when the mold temperature is below the set temperature, all the water has frozen into ice. A means in the form of an ice-ejecting pad normally positioned in the lower portion of the cavity is included to remove ice pieces from the cavity by raising them up out of the cavity clear of the mold to be swept into a storage bin by a sweep arm.

Although not generally appreciated, 32° F more accurately represents the melting temperature of ice, rather than the initial freezing temperature of water, at least in the absence of a nucleating or "seeding" agent. In most cases, when a quantity of water is cooled for the purpose of freezing it, a temperature well below 32° F is required to initiate freezing. A temperature as low as 25° F is not at all unusual. This phenomenon of liquid water existing below 32° F is known as supercooling and is the rule, rather than the exception. In order for ice crystals to form in water cooled to 32° F or below, initial nucleation must occur. Initial nucleation is usually a random event, occurring at no particular temperature, and may be triggered, for example, by small foreign particles, mold irregularities, or mechanical movement. In the case of a foreign particle as a nucleating agent, the closer the crystal structure of the foreign particle to the crystal structure of ice, the more effective it is and the less supercooling required before freezing occurs. In any event, the lower the temperature, the easier it is to initiate ice crystal formation. If the temperature is lowered sufficiently, eventually an initial ice nucleate forms spontaneously. It should be noted that, once an initial "seed" ice crystal is formed, the entire quantity of water can freeze with no further difficulty.

In an automatic icemaker of the above-described type, the thermostat which initiates ejection of the ice pieces from the mold cavities is typically set at 16° F with a tolerance of ± 3° F. As mentioned above, when the mold cools down to the set temperature, it is assumed that water in the mold cavities is completely frozen into ice. However, due to the supercooling effect, the mold and the liquid water in the ice-forming cavities can remain liquid even down to the temperature at which it is assumed that ice has been formed, and premature initiation of the ice-harvesting cycle occurs.

This is particularly likely when a particular thermostat sample happens to respond to a temperature at the high end of the tolerance range, that is, 19° F.

When this premature initiation occurs, the ejecting pads in the bottom of the ice-forming cavities rise up through liquid water, of course not removing any ice piece and having no real effect. When the next metered quantity of water enters the icemaker, since the cavities are already full, water simply overflows into the ice-storage bin below, resulting in an unusable congealed mass of ice.

This problem of liquid water entering the ice-storage bin is particularly insidious because it occurs so infrequently, perhaps only once in every three or four hundred complete operating cycles in particular icemaker samples which are prone to it. As a result, the true cause is not apparent, especially since the sequence of events is rarely actually observed in an automatic icemaker. In an effort to "repair" the icemaker, parts such as switches and solenoid valves may be replaced, only to have another quantity of water mysteriously discharged into the ice-storage bin months later.

One way to make it statistically unlikely for supercooling to cause any problem is simply to employ a thermostat set to a very low temperature, for example 10° F or lower, since it is unlikely that super-cooling would continue to such a low temperature. The disadvantage of this approach lies in a decreased rate of ice production. It simply takes the mold and water or ice contained therein longer to reach such a low temperature, with no attendant advantage if ice has in fact formed.

Another approach might be the use of a particular chemical nucleating or "seeding" agent such as silver iodide or lead iodide. Such substances are known to initiate crystallization, causing liquid water to freeze into ice reliably at a relatively high temperature (still under 32° F). While it might be possible to include such a nucleating substance within an icemaker mold, there are certain drawbacks to such an approach. For example, the substance chosen must have very low solubility in water so as not to be dissipated and, of course, must be nontoxic. Furthermore, no such material is as effective as ice itself in nucleating water close to 32° F. This follows from the fact that these substances can only approach the structure of ice, but cannot be identical.

SUMMARY OF THE INVENTION

Accordingly, it is an object of the invention to minimize super-cooling of the mold water in a refrigerator automatic icemaker.

It is another object of the invention to provide apparatus for use in a batch type automatic icemaker to reliably provide a "seed" crystal of ice to promote freezing of the mold water at a temperature just under 32° F.

It is still another object of the invention to minimize supercooling of icemaker mold water in an automatic icemaker and at the same time improving the rate of ice production.

These and other objects are accomplished by the invention in which a batch type automatic icemaker, for example of the above-described type, is provided with a water-carrying member having first and second ends. The first end of the water-carrying member device is in fluid communication with at least one of the ice-forming cavities and positioned to be wetted by water therein. The second end projects into cold air within the freezer.

A quantity of water is carried out of the cavity and is thereby thermally isolated from the bulk of the water in the cavity and exposed to the cold air at the second end of the water-carrying member. Since the temperature in the freezing compartment is typically around 0° F, this small, thermally isolated quantity of water is rapidly lowered to a temperature sufficiently low for reliable freezing, even if some supercooling occurs. A seed crystal is thereby formed which grows and travels through the member to initiate freezing of the bulk of the water in the ice-forming cavity with a minimum of supercooling therein.

In one embodiment, the water-carrying member is a capillary device which projects above the mold and draws water up out of the ice-forming cavity. The capillary device may, for example, take the form of a wick or a conventional capillary tube having a single, fine bore. For best thermal isolation, the capillary device is made of a non-metallic substance.

In another embodiment, the water-carrying member is simply a tube oriented so that water flows by gravity through the tube to the second end of the tube.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

FIG. 1 is a side elevational view of a refrigerator automatic icemaker with a portion thereof cut away in partial section;

FIG. 2 is a graph plotting mold temperature against time throughout one operating cycle in a typical prior art icemaker not including the present invention;

FIG. 3 is a graph showing an actual distribution of the temperatures at which freezing began over a number of operating cycles in an actual prior art icemaker not including the present invention;

FIG. 6 is a sectional view along Line 6-6 of FIG. 1;

FIG. 7 is a sectional downward view along Line 7-7 of FIG. 6;

FIG. 8 is a view in partial section and similar to FIG. 6, but illustrating another form of water-carrying member according to the present invention;

FIG. 9 is a view similar to FIG. 8, illustrating a modification thereof;

FIG. 10 is a graph similar to that of FIG. 2 but illustrating a typical temperature versus time plot of an icemaker including the present invention; and FIG. 11 is a graph similar to that of FIG. 3 showing a distribution of temperatures at which freezing is initiated in an icemaker including the present invention.

DESCRIPTION OF THE PREFERRED EMBODIMENTS

Figure 4:
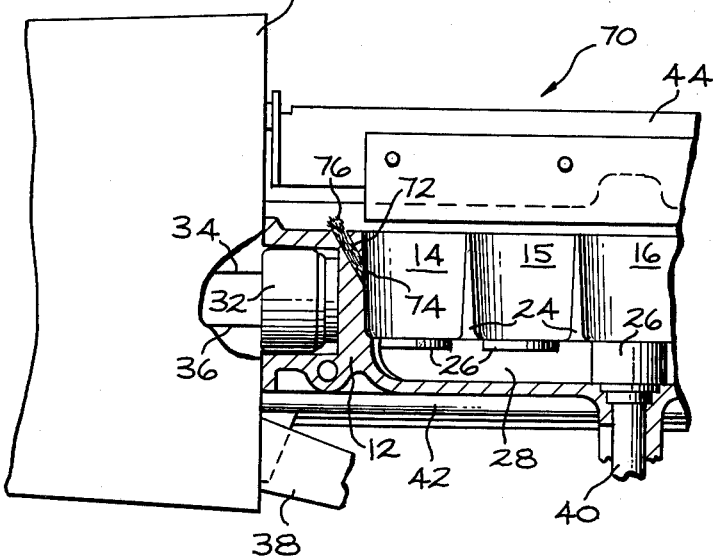
FIG. 4 is a portion of an icemaker including one embodiment of the present invention in the form of a capillary device comprising a wick.

Referring now to the drawings wherein identical reference numerals designate identical or corresponding elements in the various views, in FIG. 1 there is generally shown an automatic icemaker 10 including an aluminum mold 12 having generally cylindrical ice-forming cavities 14 through 18 arranged in a straight line and separated from one another by walls 24 which include vertical passages providing means for the flow of water from one cavity to another during the mold-filling operation. Aluminum heat exchange fins 25 (FIG. 6) are formed on the rear of the mold 12 for an improved rate of cooling. A plurality of ejection pads or pistons 26, which to a substantial extent form the bottoms of the cavities 14 through 18, are interconnected by a bar 28 slidably received in the passages in the walls 24.

A mechanism including power and control means for operating the icemaker is generally contained within a housing 30 secured to one end of the mold 12. As part of the control means, a temperature responsive switch element or thermostat 32 is disposed in thermal contact with the mold 12 to initiate harvesting of the ice pieces when they are formed. Conductors 34 and 36 connect the thermostat 32 to circuitry (not shown) for energizing a drive motor (not shown) included within the housing 30. The motor is operatively connected through drive means including a lever 38 and a rod 40 designed to raise the pads 26 and ice pieces carried thereby up out of the ice-forming cavities 14 through 18. In order to warm the mold 12 slightly to free the ice pieces for easy removal from the ice-forming cavities, a heating element 42 thermally contacts the lower portion of the mold 12 and is electrically connected so as to be energized along with the motor. An elongate rake or sweep arm 44, also connected to the mechanism within the housing 30, is provided to sweep the ice pieces which have been raised by the pads 26 to the top of the mold 12 off into an ice-storage bin (not shown).

At the other end of the mold 12, a funnel 46 is positioned to receive metered quantities of tap water for filling the ice-forming cavities 14 through 18. An electrically operated solenoid valve (not shown) connected to the icemaker control means controls the water entering the funnel 46.

In the general operation of the icemaker 10 as thus far described, an operating cycle begins with a metered quantity of water entering through the funnel 46 to fill the ice-forming cavities 14 through 18. A representative temperature for tap water entering the icemaker is 50° F. The entire mold 12 warms quickly up to nearly the water temperature. As the mold 12 and the water within the cavities lose heat to the cold air within the freezer, the freezer air temperature being typically 0° F, the mold and water temperature gradually decreases. At some temperature below 32° F, the water in the ice-forming cavities begins to freeze and eventually becomes completely frozen. When the mold temperature reaches approximately 16° F, the thermostat 32 initiates harvesting of the ice pieces. The harvesting operation includes energizing of the heating element 42 to free the ice pieces from the cavities, ejection of the ice pieces by movement of the pads 26 from their lower positions in the bottom of the cavities to a raised position slightly above the upper surface of the mold 12, pivotal movement of the sweep arm 44 across the top of the mold for engaging the ejected ice pieces and sweeping them from the mold, and return of the sweep arm 44 and the pads 26 to their normal positions. This is followed by the introduction of another metered quantity of water through the funnel 46 into the ice-forming cavities to begin the next operating cycle.

A more detailed description of this general type of icemaker and its operation may be had by reference to the above-mentioned U.S. Pat. Nos. 3,163,017 and 3,163,018, which are hereby incorporated by reference.

Referring now to FIG. 2, there is illustrated a plot of mold temperature versus time throughout one operating cycle, beginning with the filling of the ice-forming cavities 14 through 18 and ending with harvesting, in a typical prior art automatic icemaker. While the exact length of one such cycle depends upon factors such as temperature of incoming water, temperature within the freezing compartment, and the amount of air circulation directly over the icemaker, a typical length of time is forty minutes. Mold temperatures are represented on the vertical axis of the graph, with a horizontal line 48 extending from the 32° point to indicate the theoretical freezing point of water and a dash horizontal line 50 extending from 19° to indicate the upper end of the tolerance range of a typically-employed, temperature-responsive switch element such as the thermostat 32 (FIG. 1). As a practical matter in mass production, such thermostats are acceptable when they respond to any temperature within a predetermined range of temperatures, for example 16° ± 3° F.

Considering FIG. 2 in detail as it relates to the operating cycle of the icemaker, the solid line 52 is the actual plot of temperature versus time. At the point 54 when tap water initially enters the mold cavities, the water temperature in the mold cavities is approximately 50° F, more or less, depending upon the actual temperature of the incoming water and the mass and initial temperature of the mold 12. The mold and the water gradually cool, as shown by the line segment 56. At the point 58, the mold and water temperature reach and pass through 32° F, but no freezing occurs. A region of supercooling is entered, represented by line segment 60. During this time, water in the mold cavities remain liquid. When the water temperature reaches 20°, indicated by point 62, an initial ice crystal is formed and rapid formation of ice in the cavities results. Due to communication between the cavities, an initial ice crystal forming anywhere within any one of the cavities is effective to cause ice crystallization throughout. The formation of the initial ice crystal is a very random event, and the temperature at which it occurs cannot be predicted with certainty in any given cycle. The same icemaker, in successive cycles, may initiate formation of ice crystals at a temperature anywhere within a range beginning at 32° F and extending downward through 20° F.

Once ice crystal formation is initiated, due to the heat of fusion released by the water as it freezes into ice, the water and mold temperature rises rapidly to 32° F. This rapid rise in temperature (from point 62 to point 64) is a sensitive indicator of actual ice formation, and is confirmed by visual observation. The ice pieces form by freezing from the outside in, and until each piece is frozen all the way through to the center, the temperature remains near 32° F. As soon as the water is all completely frozen, beginning at the point 66, there is no more heat of fusion to overcome and the temperature again rapidly falls until it reaches 19° F (point 68), whereupon the thermostat 32 initiates the harvesting cycle.

In FIG. 2, it will be apparent that the point 62 is only 1 degree higher than the 19° line 50. If the super-cooling region 60 had continued just a bit farther, the thermostat 32 would have prematurely initiated the harvesting cycle. Since the pads 26 would be moving upward through liquid water, and not against ice pieces, the water would remain in the mold. When the next metered quantity of water entered through the funnel 46, the water, having no place to go, would flow into the ice-storage bin (not shown) disposed below the icemaker 10, eventually freezing into a solid lump along with any ice pieces previously stored therein. Sometimes the mechanical movement of the pads 26 up through the supercooled water in the ice-forming cavities is sufficient to trigger ice crystal formation. Even though ice rapidly forms, at this point it is too late. At best, there is only time for a "slush" to form before the pads 26 complete their upward travel.

In FIG. 3, there is shown an actual distribution of temperatures at which freezing began over successive operating cycles in the same icemaker. This chart was compiled by continuously measuring and recording the mold temperature to produce plots such as FIG. 2, and specifically recording the temperature represented by point 62. As shown in FIG. 3, the distribution is quite spread out, indicating that formation of the initial ice crystal to trigger complete freezing is most likely to occur somewhere between 29° and 25° F, but can be much lower in isolated instances.

Referring now to FIG. 4, there is shown a portion of an icemaker 70 including one embodiment of the present invention. The icemaker 70 includes a water-carrying member 72 having first and second ends 74 and 76. The first end 74 is in fluid communication with the ice-forming cavity 14 for wetting by water therein. The second end 76 projects into cold air within the freezing compartment. Preferably, the second end 76 is located so as to be exposed directly to fan-forced cold air emerging from the refrigeration evaporator which is a part of the refrigerator within which the icemaker 70 is installed.

The particular water-carrying member 72 illustrated is a capillary device in the form of a wick, which may be formed of either metallic fibers or any other suitable fiber such as cotton, nylon, rayon, or the like. As is well known, such a wick has the capability of drawing water upward against the flow of gravity through capillary action which occurs due to surface tension characteristics of water. Alternatively, the illustrated capillary device 72 may be an equivalent wick-like porous solid material, for example porous ceramic or porous sintered material. Such porous solids also have the capability of drawing up water through capillary action.

In the operation of the icemaker 70, when the mold cavities including the ice-forming cavity 14 are filled with water, the first end 74 is wetted and a small quantity of water is drawn up to the second end 76. Due to the small size of the capillary device 72 and the low thermal conductivity of a material of which it may be made, a small quantity of mold water is thermally isolated at the second end 76 and exposed to cold air within the freezing compartment. Due to the low thermal mass of this small quantity of water and its thermal isolation from the mold 12 and from the bulk of the water, it may be rapidly cooled to very near the temperature within the freezing compartment of the refrigerator. Since this is typically 0° F, even if some supercooling does occur, it is quite unlikely that the supercooling region will extend all the way down to this low temperature. Consequently, a "seed" ice crystal is reliably formed and, as the entire mold 12 cools, this initial crystal grows downward through the wick to seed the water in the cavity 14. This ice seed then promotes crystallization and freezing of the water in the mold cavities at a temperature only slightly below 32° F, with a minimum of supercooling of the water in the mold cavities.

Figure 5:
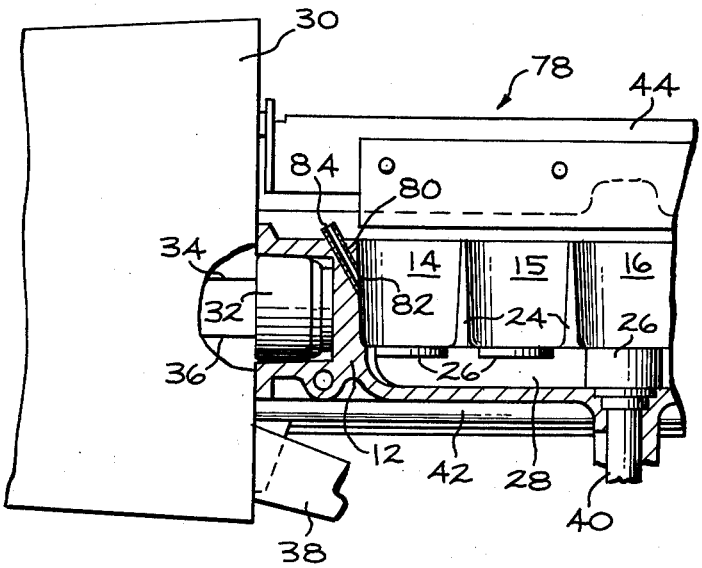
FIG. 5 is a portion of an icemaker including another embodiment of the present invention in the form of a capillary device comprising a capillary tube.

Referring now to FIG. 5, there is illustrated an icemaker 78 including another form of capillary device which is a water-carrying member in the contemplation of the invention. In this embodiment, a capillary device 80 having first and second ends 82 and 84 is a capillary tube comprising a plastic rod having an extremely fine bore longitudinally through the center. The operation of the embodiment illustrated in FIG. 5 is otherwise identical to the operation of the device illustrated in FIG. 4 and the description thereof need not be repeated.

Referring now again to FIG. 1 and additionally to the enlarged sectional views of FIGS. 6 and 7, there is illustrated another form of a capillary device which may be used. While the present invention in its broader aspects comprehends the embodiment of FIGS. 1, 6, and 7, the specific embodiment illustrated in FIGS. 1, 6, and 7 is not the subject matter of the present invention, but rather is the sole invention of Frank A. Schumacher.

This embodiment includes a capillary device 86 having first and second ends 88 and 90. The capillary device 86 comprises two closely-spaced parallel plates 92 and 94 formed of plastic material. The parallel plates 92 and 94 are held in position by being wedged into a suitable recess 96 in the sidewall of the ice-forming cavity 14, and positioned within the discharge opening 98 of the funnel 46. Due to surface irregularities and a slight curvature, a sufficient gap is formed between the parallel plates 92 and 94 to act as a capillary to draw water out of the ice-forming cavity 22 up to the second end 90. This resultant small quantity of water is thermally isolated and exposed to cold air within the freezing compartment of the refrigerator.

The operation of the embodiment illustrated in FIGS. 1, 6, and 7 is the same as the operation of the embodiments shown and described with reference to FIGS. 4 and 5, with the exception that reliability is enhanced by the positioning of the capillary device 86 within the discharge opening 98 of the funnel 46, and by the parallel plate construction itself. Water entering at the beginning of each operating cycle tends to wash over and carry away any residue which may result due to minerals dissolved in the water. As a result, the capillary device 86 is less prone to become clogged and ineffective. Further, the location of the device 86 advantageously places it in a substantial cold airstream, since the cold evaporator air is generally discharged into the rear of the freezer compartment.

While particular capillary devices have been illustrated and described herein, it will be apparent that numerous other capillary devices are possible. For example, solids can be provided with "frosted" surfaces formed, for example, by grit blasting or acid etching. Such surfaces can be made sufficiently wettable to draw up water against the force of gravity.

As an alternative to a capillary device, the water-carrying member of the present invention may be a tube having its first end in communication with an ice-forming cavity and oriented so that water flows by gravity to the second end of the tube. Preferably, the tube is plastic for thermal isolation of the second end from the mold body. Referring to FIG. 8, such a tube is designated 100. The tube 100 has a first end 102 in fluid communication with the ice-forming cavity 18 for wetting by water therein. A second end 104 of the tube 100 extends downwardly and projects into cold air within the freezer compartment. To prevent water from flowing out of the end 104, it is sealed off in FIG. 8. Alternatively, as shown in FIG. 9, the tube 100 can be open-ended, having an end 104' located higher than the water fill level of the cavity 18.

The operation of the embodiments of FIGS. 8 and 9 is generally the same as the previously described embodiments in that a small quantity of water is carried from the ice-forming cavity 18 to the tube end 104. The small quantity of water is thermally isolated from the mold 12, and is rapidly cooled to a sufficiently low temperature for reliable freezing, even if some supercooling does occur. A "seed" ice crystal is thereby reliably formed, and as the entire mold 12 cools, this initial seed ice crystal grows through the tube 100 to seed the water in the cavity 18 to trigger ice crystal formation. These embodiments differ from the previously described embodiments in that gravity rather than capillary action, carries water through the water-carrying member.

Referring now to FIG. 10, there is illustrated a plot comparable to FIG. 2 but illustrating the benefit derived from the use of the present invention. In FIG. 10, a point 106 at which ice forming is initiated is consistently about 28° or 29° F, well above the 19° F set point of the thermostat 32. This provides a considerable margin of safety insofar as minimizing the chance of supercooling. Furthermore, if desired, the set point of the thermostat 32 can be raised above 19° F for increased ice production rates. Increased ice production can result because time is not wasted chilling ice pieces further once they have already become frozen. However, there is an upper limit above which the temperature set point cannot be raised without the risk of ejecting only partially frozen ice pieces. Since the ice pieces freeze from the outside in, and the ice itself is somewhat of a thermal insulator, the outer portions of ice pieces as they are forming may be lower in temperature than the still-unfrozen water in the center. Keeping the set point sufficiently low, for example below 25° F, insures that sufficient time is allowed for thorough freezing of the ice pieces.

Referring now to FIG. 11, there is graphically illustrated a distribution similar to that of FIG. 3, showing the temperatures at which ice formation began during each of an actual series of consecutive icemaker operating cycles. As shown, when the present invention is employed, freezing consistently occurs at or above 28° F.

It will be apparent, therefore, that the present invention provides apparatus for minimizing the supercooling effect in a batch type automatic icemaker and which permits upward adjustment of the thermostat set point to increase the rate of ice production, without the risk of excessive supercooling. Although the invention has for convenience been illustrated and described with reference to a particular type of batch type automatic icemaker, it will be apparent that it could be applied equally well to other types of batch type icemakers.

While specific embodiments of the invention have been illustrated and described herein, it is realized that modifications and changes will occur to those skilled in the art. It is therefore to be understood that the appended claims are intended to cover all such modifications and changes as fall within the true spirit and scope of the invention.

What is claimed is:

1. In a batch type automatic icemaker adapted for installation in the freezing compartment of a refrigerator and including a mold having an ice-forming cavity, means for filling said cavity with water, control means, and means responsive to the control means for removing ice pieces from the cavity, the improvement comprising:

a water-carrying member having first and second ends, said first end in fluid communication with the cavity for wetting by water therein, and said second end projecting into cold air within the freezing compartment;

whereby a small thermally isolated quantity of mold water is exposed to cold air at said second end and rapidly lowered to a temperature sufficiently low to reliably provide a seed ice crystal to initiate freezing of water in the ice-forming cavity with a minimum of supercooling.

2. An icemaker according to claim 1, wherein said water-carrying member is a tube oriented so that water flows by gravity through said tube to the second end of said tube.

3. In a batch type automatic icemaker adapted for installation in the freezer compartment of a refrigerator and including a mold having an ice-forming cavity, means for filling said cavity with water, control means, and means responsive to the control means for removing ice pieces from the cavity, the improvement comprising:

a capillary device having first and second ends, said first end in fluid communication with the cavity for wetting by water therein, and said second end projecting into cold air within the freezer;

whereby a small thermally isolated quantity of mold water is exposed to cold air at said second end and rapidly lowered to a temperature sufficiently low to reliably provide a seed ice crystal to initiate freezing of water in the ice-forming cavity with a minimum of supercooling.

4. An icemaker according to claim 3, wherein said capillary device is a wick.

5. An icemaker according to claim 4, wherein said wick comprises fibers.

6. An icemaker according to claim 5, wherein said wick fibers are metal.

7. An icemaker according to claim 3, wherein said capillary device is a capillary tube.

8. An icemaker according to claim 3, wherein said capillary device is formed of a porous solid material.

9. An icemaker according to claim 8, wherein the porous solid material comprises porous ceramic.

10. An icemaker according to claim 8, wherein the porous solid material comprises sintered metal.

* * * * *